United States Patent [19]

Dreher et al.

[11] 4,265,604

[45] May 5, 1981

[54] ROTARY PNEUMATIC TOOL WITH VALVE-CLOSING PIN ACTUATED UPON OVERSPEED

[75] Inventors: Ernst Dreher, Reutlingen; Reinhold Stroezel, Leinfelden-Echterdingen; Siegfried Spittler, Wiesenstetten; Richard Wolf, Stuttgart, all of Fed. Rep. of Germany

[73] Assignee: Robert Bosch GmbH, Stuttgart, Fed. Rep. of Germany

[21] Appl. No.: 24,778

[22] Filed: Mar. 28, 1979

[30] Foreign Application Priority Data

May 13, 1978 [DE] Fed. Rep. of Germany ..... 2821074

[51] Int. Cl.[3] ..... F01C 21/12; G05D 13/04

[52] U.S. Cl. ..... 418/43; 137/57

[58] Field of Search ..... 418/40–44; 137/57

[56] References Cited

U.S. PATENT DOCUMENTS

| | | | |
|---|---|---|---|
| 2,586,968 | 2/1952 | Maclay | 418/43 |
| 3,519,372 | 7/1970 | Peale | 418/43 |
| 3,767,332 | 10/1973 | Wickham et al. | 418/43 |
| 3,923,429 | 12/1975 | Schaedler et al. | 418/43 |
| 4,090,821 | 5/1978 | Barrows et al. | 418/43 |
| 4,184,819 | 1/1980 | Clark | 418/43 |

*Primary Examiner*—John J. Vrablik

*Attorney, Agent, or Firm*—Michael J. Striker

[57] ABSTRACT

A pneumatic tool includes a fluid motor with a rotor and passages for connecting the rotor with a source of fluid under pressure. A normally open valve is interposed in the passages and movable to a closed position in which it interrupts the flow of fluid to the rotor. An actuator is located on the rotor and operative, in response to the rotor exceeding a predetermined speed of revolutions, to move from a neutral into an actuating position in which it engages the valve and moves the same to the closed position thereof.

10 Claims, 4 Drawing Figures

ROTARY PNEUMATIC TOOL WITH VALVE-CLOSING PIN ACTUATED UPON OVERSPEED

BACKGROUND OF THE INVENTION

The present invention relates to a pneumatic tool.

It is known in the prior art to provide a pneumatic tool having a fluid motor which includes a rotor and passages for connecting the rotor with a source of fluid. A normally open valve member is interposed in the passages and is movable to a closed position in which it interrupts the flow of the fluid to the rotor.

In U.S. Pat. No. 3,749,530, there is described a cup spring which is mounted on the rotor for rotation therewith along the line of the passage. The cup spring is provided with a number of weights. Thus, should the speed of revolutions of the rotor exceed a predetermined level, the weights bend the cup spring so that the latter closes the passage to thereby interrupt the flow of the fluid to the rotor. As a result of the fluid-flow interruption the fluid motor is shut down. In order to renew the operation an operator has to open a corresponding closure of the motor and bend the cup spring back into its normal uncompressed position so as to open the passage for the fluid flow to the rotor. Simultaneously, the operator may find out and eliminate the cause of the undesired increase of the speed of the rotor.

This device is very simple in manufacturing and assembling. It has been found, however, that the cup spring during its bending, in order to close the fluid-flow passage and subsequently shut down the fluid motor, unavoidably abrades small particles which are then aspirated by the motor and can cause damage.

Usually, a fluid motor is very sensitive to any foreign particles, no matter how small they are. Thus, for example, a foreign body in a circumferential gap between a vane and an inner surface of the stator of the fluid motor may cause damage to the motor (i.e. an undesired groove may develop on the highly precise inner surface of the stator).

In U.S. Pat. No. 3,930,764 it has been suggested to utilize a light plate of synthetic plastic material, which is interposed in the fluid-flow passage. The plate is rotatable with the rotor of the fluid motor and prevented against an axial movement relative to the rotor. A plate is provided with a substantially straight wire spring which is connected to a small counterweight. When the speed of revolution of the rotor exceeds a predetermined level the counterweight lifts the wire spring from a corresponding groove on the rotor and the fluid flow under pressure entrains the plate until the latter abuts a partition on the rotor so as to close an inlet through which the fluid flow enters the motor. In such a position the plate stays and prevents any fluid flow to the rotor of the fluid motor.

While in the case of the U.S. Pat. No. 3,749,530 the fluid motor is shut down due to the biasing force of the bend cup spring, the plate of the U.S. Pat. No. 3,930,764 stays in the closed position thereof due to the pressure differential in the passage upstream and downstream of the plate. The plate has a relatively large diameter. On the other hand, the thickness of the plate is rather small, especially if considered in relation to the diameter thereof. Under a relatively high pressure, applied to the plate when the latter is in the closed position, the plate may become tilted or bent so as to cause an undesired leak of the fluid in the fluid-flow passage. Therefore, in order to eliminate this potential danger one has to reduce the pressure on the plate when the latter is in the closed position, which fact considerably reduces the reliability of the closing of the fluid-flow passage by such a plate.

SUMMARY OF THE INVENTION

It is a general object of the present invention to avoid the disadvantages of the prior art pneumatic tools.

More particularly, it is an object of the present invention to provide an arrangement for closing a fluid-flow passage, which can operate fast and in a simple and reliable manner.

Another object of the present invention is to provide an arrangement for closing a fluid-flow passage with a relatively high pressure so as to prevent any possible hindrance during the closing operation.

Still another object of the present invention is to provide an arrangement for closing a fluid-flow passage which during the closing operation does not cause any downward pressure.

A further object of the present invention is to provide an arrangement for closing a fluid-flow passage which cannot provoke any subsequent damage of a fluid motor.

These objects and others which will become apparent hereinafter are attained, in accordance with the present invention, in a pneumatic tool which comprises a fluid motor including a rotor, and passage means connecting said rotor with a source of fluid under pressure. According to the invention, normally open valve means are interposed in said passage means and movable to a closed position in which they interrupt the flow of fluid to said rotor.

According to an important feature of the invention, the valve means are actuated by actuating means located on said rotor, in response to said rotor exceeding a predetermined speed of revolution. The actuating means move from a neutral into an actuating position in which it engages said valve means and move the same to said closed position thereof.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
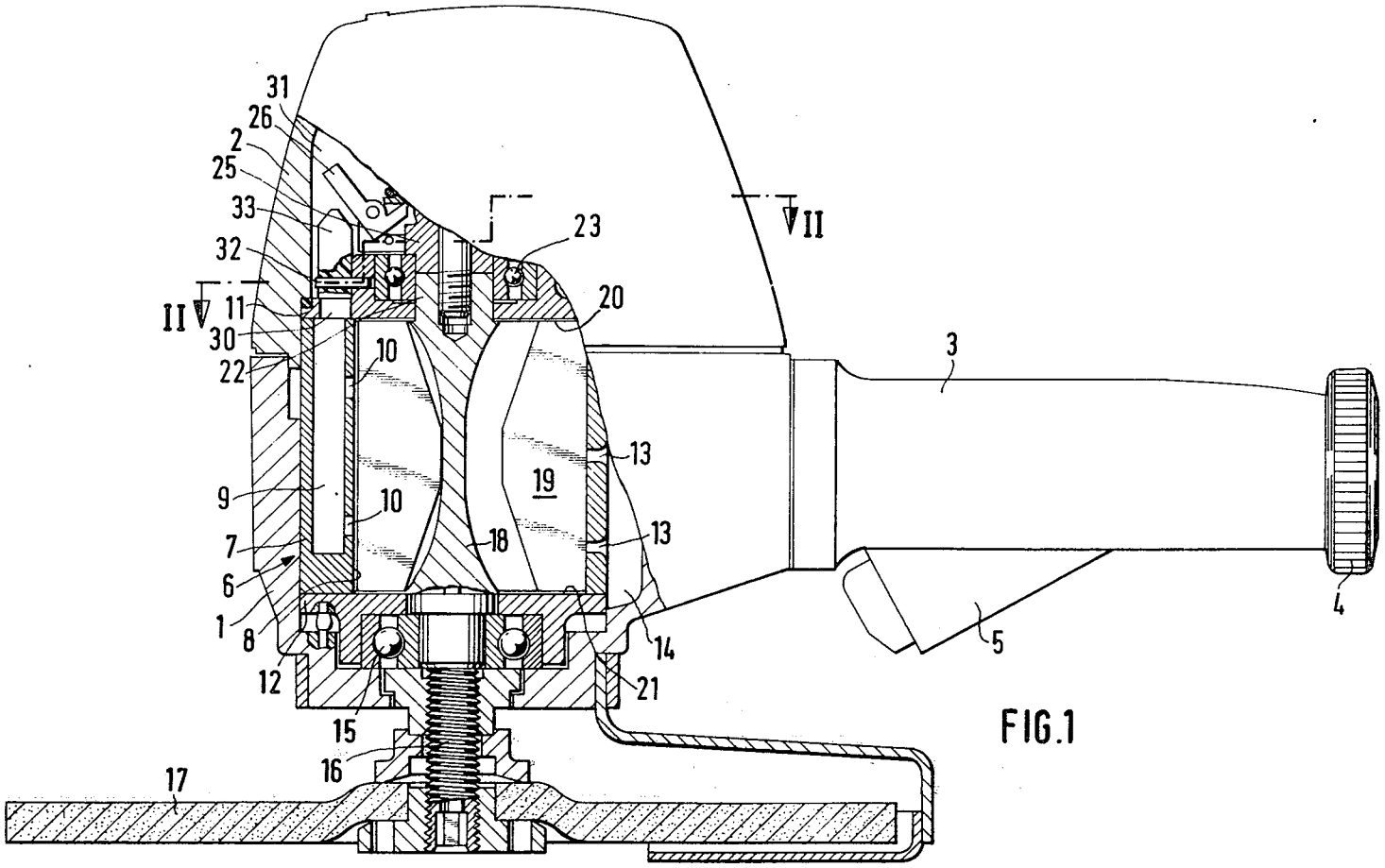
FIG. 1 is a partly sectioned view of a pneumatic tool in accordance with the present invention.

As can be seen in FIG. 1 the reference numeral 1 is used to designate a motor housing of a pneumatic tool. The motor housing 1 may be of metal. An operating housing 2 (e.g. metallic) is attached to the motor housing 1 which is provided with a handle 3, for example, of synthetic plastic material. The handle 3 has a pipe connection 4 (e.g. with a thread portion) connectable to a supplying conduit which is connected to a source of fluid under pressure for operating a vane type fluid motor 6 which is mounted in the motor housing 1. The source of the fluid and the supplying conduits are known per se and, therefore, do not require a detailed discussion or illustration. The handle 3 is further provided with a trigger switch 5 which operatively connects the vane motor 6 with the fluid conduit.

The motor 6 has a cylindrical stator 7 which is open at both end portions thereof. The stator 7 is provided with an inner eccentric recess 8. The circumferential wall of the stator 7 has a varying thickness. One portion of the circumferential wall has a relatively large thickness and is provided with another recess 9 which extends parallel to the axis of the recess 8. The recess 9 has one end 30 communicating with an interior 31 of the operating housing 2 and a number of inlet openings 10 which connect the recess 9 with the recess 8. Thus, the fluid from the interior 31 of the operating housing 2 enters under pressure into the recess 9 and further through the inlet openings 10 into the interior of the stator 7, that is into the recess 8.

The interior of the stator 7 is closed at one end thereof by a closure 11 and at another end thereof by a closure 12. A portion of the circumferential wall which has a relatively small thickness is provided with a number of outlet openings 113 for discharging the fluid from the interior of the stator 7, that is from the recess 8. In the preferred embodiment of the present invention the outlet openings 13 are located opposite to the inlet openings 10, respectively. The outlet openings 13 are connected with a discharging passage 14.

The closure 12 is provided with a ball bearing 15 which is located eccentrically relative to the axis of the recess 8 for supporting a spindle 16. A grinding wheel 17 is mounted on a free end of the spindle 16. The opposite end of the spindle 16 is connected to a rotor 18 of the motor 6. In the preferred embodiment, the rotor 18 is integrally connected to the spindle 16. The rotor 18 is provided with a number of vanes 19, which are tightly inserted in the corresponding slits on the rotor 18. The vanes 19 are sealingly guided along the inner circumference of the stator 7, the inner surface 20 of the closure 11 and the inner surface 21 of the closure 12. The rotor 18 is provided with a coaxial trunnion 22 which extends through the closure 11 into the operating housing 2. The trunnion 22 is provided with a ball bearing 23 for rotatably supporting the corresponding end portion of the rotor 18 on the closure 11.

A switch base 25 is coaxially connected to the trunnion 22 by means of a screw 24. Two counterweights 26 are mounted on the switch base 25 which is provided with a hole 25' for a slidable rod 27 (see FIG. 2). The counterweights 26 are known in the art and disclosed, for example in the U.S. Pat. No. 2,925,089. These counterweights are normally employed for regulating pressure fluctuations of the pressure medium, which may occur in the pneumatic tool equipment. The movement of the counterweights 26 is limited by means of respective end stops 28. The end stops 28 are provided to restrict the further pivotal movement of the counterweights 26 to thereby prevent the stroke against the inner surface of the housing 2. The slidable rod 27 is held within the switch base 25 by means of a helical spring 29.

A pin 32 is located adjacent the open end 30 of the recess 9 of the stator 7. A valve plate 33 is pivotably mounted on the pin 32. The valve plate 33 is normally so located as to keep the end 30 of the recess 9 open into the interior 31 of the operating housing 2 so as to permit the fluid to flow therefrom through the recess 9 and the inlet openings 10 into the recess 9 and the inlet openings 10 into the interior of the stator 7. The valve plate 33 may pivot to a closed position so as to sealingly interrupt the communication between the recess 9 and the interior 31 of the operating housing 2. In the closed position the valve plate 33 closes the open end 30 of the recess 9 so as to prevent the fluid from flowing in the recess 9 from the interior 31 of the operating housing 2. The valve plate 33 may be of synthetic plastic material, for example, polyurethane, having a shore-hardness of 70-75.

In the closed position the valve plate 33 extends parallel to the closure 11 and is radially offset relative to the rotational axis of the rotor 18. In the open position, the valve plate extends normal to the closure 11 and is parallel to the rotational axis of the rotor 18.

Figure 4:
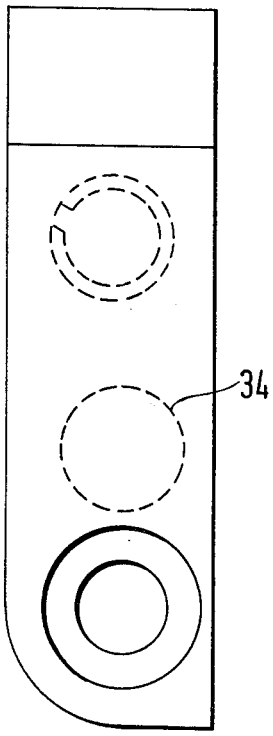
FIG. 4 is a side view of the valve shown in FIG. 3.
Figure 3:
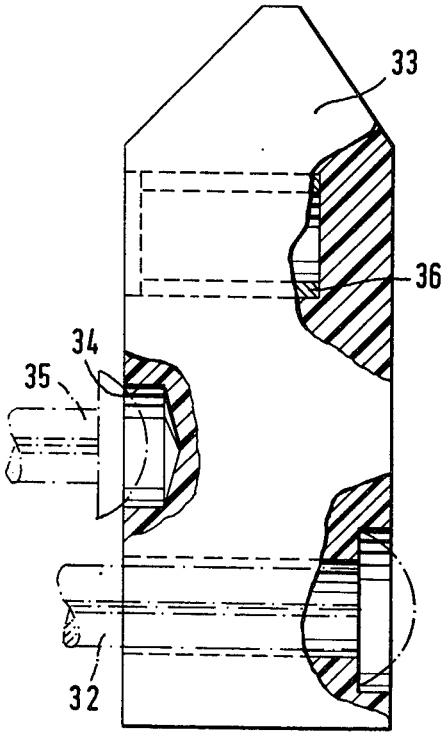
FIG. 3 is a front partly sectioned view of a valve on an enlarged scale.

In order to prevent a spontaneous movement of the valve plate 33 from its open into its closed position, the plate is provided with a radial bore 34 (FIG. 4) for receiving a roundhead of a notched pin 35 (see FIG. 3) which is mounted on the closure 11.

Figure 2:
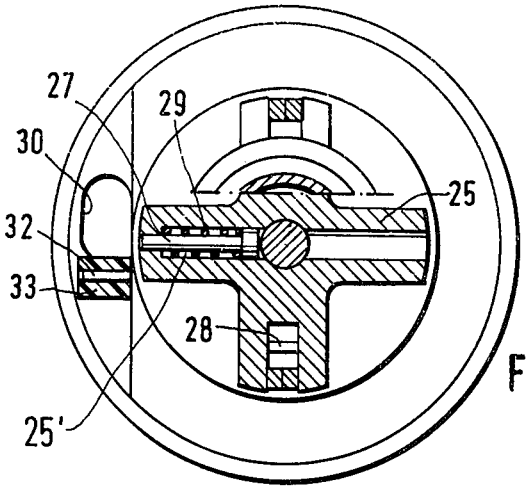
FIG. 2 is a sectional view taken along the line II—II in FIG. 1.

The open end 30 and the valve plate 33 are located outside the rotational path of the switch base 25 (see FIG. 2). When the speed of revolution of the rotor 18 exceeds a predetermined permissible level the slidable pin 27 moves, under the pressure of the correspondingly increased centrifugal force, in a direction counter to the biasing force of the spring 29, i.e. outwardly from the switch base 25. During the rotation of the rotor 18 the now protruding position of the pin 27 engages the valve plate 33 and pivots the same about the pin 32 into the closed position so as to close the open end 30 of the recess 9. Thus, the fluid no longer flows from the interior 31 of the operating housing 2 into the recess 9. The valve plate 33 is provided with a spring cotter 36, that is the latter is pressed into the valve plate 33. The spring cotter 36 may be hollow cylindrical pin of sheet steel. The spring cotter 36 reinforces the valve plate 33. It is to be understood that the metallic cotter 36 may have different shapes. It is also possible to reinforce the valve plate 33 by appropriately increasing its thickness.

It will be understood that each of the elements described above, or two or more together, may also find a useful application in other types of a pneumatic tool differing from the types described above.

While the invention has been illustrated and described as embodied in a pneumatic tool it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a pneumatic tool, a combination comprising a fluid motor including a rotor; passage means connecting said rotor with a source of fluid under pressure; normally open valve means interposed in said passage means and movable to a closed position in which it interrupts the flow of fluid to said rotor; actuating means on said rotor operative in response to said rotor exceeding a predetermined speed of revolution, to move from a neutral into an actuating position in which it engages said valve means and moves the same to said closed position thereof, said valve means including a valve plate movable between an open and said closed position; said actuating means including a pin operatively connected to said rotor for rotation therewith and movable between said neutral and actuating positions relative to said rotor; and means for reinforcing said valve plate, said reinforcing means including a metallic reinforcing element pressed into said valve plate, said reinforcing element being formed as a cotter spring.

2. In a pneumatic tool, a combination comprising a fluid motor including a rotor; passage means connecting said rotor with a source of fluid under pressure; normally open valve means interposed in said passage means and movable to a closed position in which it interrupts the flow of fluid to said rotor; actuating means arranged on said rotor and operative in response to said rotor exceeding a predetermined speed of revolutions to move from a neutral into an actuating position, said valve means including a valve plate movable between an open and said closed positions, said actuating means including a pin operatively connected to said rotor for rotation therewith and movable between said neutral and actuating positions relative to said rotor, said valve plate being located adjacent said rotor so that when said pin is in said actuating position it engages said valve plate during the rotation of said rotor to thereby move said valve plate to said closed position; means for preventing movement of said pin between said neutral and actuating positions until the speed of revolutions of said rotor exceeds said predetermined speed level; and means for preventing spontaneous movement of said plate between said open and closed positions, said valve plate being provided with a hole, and said spontaneous-movement-preventing means including a stationary pin engageable with said hole on said valve plate with a snapping action when said valve plate is in said open position.

3. A combination as defined in claim 2, wherein said pin has a roundhead adapted to snap into the hole in said valve plate when the latter is in said open position

4. A combination as defined in claim 2, wherein the first mentioned preventing means include a spring having a biasing force smaller than a centrifugal force corresponding to said predetermined speed of revolutions of said rotor.

5. A combination as defined in claim 4, wherein the first mentioned preventing means include a spiral spring.

6. A combination as defined in claim 2, wherein said rotor is provided with a portion having a passage receiving said pin, said portion being further provided with counterweight means.

7. A combination as defined in claim 6, wherein said counterweight means include two weights mounted on said portion of said rotor.

8. A combination as defined in claim 2, wherein said valve plate is of synthetic plastic material.

9. A combination as defined in claim 8, wherein said valve plate is of polyurethane.

10. A combination as defined in claim 8, wherein said synthetic plastic material has shore-hardness of 70–75.

* * * * *